US010704330B2

(12) United States Patent
Clausen

(10) Patent No.: US 10,704,330 B2
(45) Date of Patent: Jul. 7, 2020

(54) DRILLING SYSTEMS AND HYBRID DRILL BITS FOR DRILLING IN A SUBTERRANEAN FORMATION AND METHODS RELATING THERETO

(71) Applicant: National Oilwell DHT, L.P., Conroe, TX (US)

(72) Inventor: Jeffery Ronald Clausen, Houston, TX (US)

(73) Assignee: NATIONAL OILWELL DHT, L.P., Conroe, TX (US)

( * ) Notice: Subject to any disclaimer, the term of this patent is extended or adjusted under 35 U.S.C. 154(b) by 83 days.

(21) Appl. No.: 15/039,622

(22) PCT Filed: Dec. 5, 2014

(86) PCT No.: PCT/US2014/068864
§ 371 (c)(1),
(2) Date: May 26, 2016

(87) PCT Pub. No.: WO2015/085212
PCT Pub. Date: Jun. 11, 2015

(65) Prior Publication Data

US 2017/0167201 A1 Jun. 15, 2017

Related U.S. Application Data

(60) Provisional application No. 61/912,302, filed on Dec. 5, 2013.

(51) Int. Cl.
*E21B 10/14* (2006.01)
*E21B 10/16* (2006.01)
(Continued)

(52) U.S. Cl.
CPC ..... *E21B 10/14* (2013.01); *E21B 10/16* (2013.01); *E21B 10/20* (2013.01); *E21B 10/50* (2013.01)

(58) Field of Classification Search
CPC ..... E21B 10/14; E21B 10/16; E21B 10/20; E21B 10/50
See application file for complete search history.

(56) References Cited

U.S. PATENT DOCUMENTS 1,029,491 A 6/1912 Cortinas
1,391,626 A 9/1921 Gilthorpe
(Continued)

FOREIGN PATENT DOCUMENTS

CN 101892810 A 11/2010
CN 203201473 U 9/2013
(Continued)

OTHER PUBLICATIONS

European Examination Report dated Aug. 4, 2017, for European Application No. 14821955.3 (5 p.).
(Continued)

*Primary Examiner* — David J Bagnell
*Assistant Examiner* — Yanick A Akaragwe
(74) *Attorney, Agent, or Firm* — Conley Rose, P.C.

(57) ABSTRACT

Drill bits and methods relating thereto are disclosed. In an embodiment, the drill bit includes a body having a plurality of legs each having a lower section that has a leading surface and a trailing surface. A plurality of cone cutters are each rotatably mounted to the lower section of one of the legs, each having a cone axis, and including a first plurality of cutter elements arranged about the cone axis such that each is shear the formation when the body is rotated about the bit axis.

22 Claims, 13 Drawing Sheets

(51) Int. Cl.
*E21B 10/20* (2006.01)
*E21B 10/50* (2006.01)

(56) References Cited

U.S. PATENT DOCUMENTS

| | | | | |
|---|---|---|---|---|
| 2,002,388 | A | 5/1935 | Bannister | |
| 2,121,202 | A | 6/1938 | Killgore | |
| 3,066,749 | A | 12/1962 | Hildebrandt | |
| 3,695,370 | A | 10/1972 | Jones | |
| 3,765,493 | A | 10/1973 | Rosar et al. | |
| 3,847,236 | A | 11/1974 | Coalson | |
| 3,862,665 | A | 1/1975 | Wallace | |
| 4,193,463 | A * | 3/1980 | Evans | 175/337 |
| 4,256,191 | A | 3/1981 | Jones | |
| 4,446,935 | A | 5/1984 | Schumacher, Jr. | |
| 4,690,228 | A | 9/1987 | Voelz et al. | |
| 4,751,972 | A | 6/1988 | Jones et al. | |
| 6,131,675 | A | 10/2000 | Anderson | |
| 6,484,819 | B1 * | 11/2002 | Harrison | E21B 7/064 166/66 |
| 7,131,504 | B2 | 11/2006 | Odell, II et al. | |
| 8,186,458 | B2 | 5/2012 | Dewey et al. | |
| 8,985,243 | B2 | 3/2015 | Yang et al. | |
| 2011/0079443 | A1 * | 4/2011 | Buske | E21B 7/28 175/336 |
| 2011/0162893 | A1 | 7/2011 | Zhang | |
| 2013/0126246 | A1 | 5/2013 | Yang et al. | |
| 2013/0126247 | A1 | 5/2013 | Yang et al. | |
| 2015/0368977 | A1 * | 12/2015 | Yang | E21B 10/43 175/336 |

FOREIGN PATENT DOCUMENTS

| | | | |
|---|---|---|---|
| RU | 2325502 | C2 | 5/2008 |
| SU | 891882 | A1 | 12/1981 |

OTHER PUBLICATIONS

International Application No. PCT/US2014/068864 Search Report and Written Opinion dated May 27, 2015 (14 pages).
Chinese Office Action dated Jun. 29, 2017, for Chinese Application No. 201480066202.4 (9 p.).
English Translation of Chinese Office Action dated Jun. 29, 2017, for Chinese Application No. 201480066202.4 (11 p.).
Chinese Office Action dated Mar. 2, 2018, for Chinese Application No. 201480066202.4 (5 p.).
English Translation of Chinese Office Action dated Mar. 2, 2018, for Chinese Application No. 201480066202.4 (6 p.).
Russian Office Action dated May 7, 2018, for Russian Application No. 2016119250 (8 p.).
English Translation of Russian Office Action dated May 7, 2018, for Russian Application No. 2016119250 (7 p.).

* cited by examiner

DRILLING SYSTEMS AND HYBRID DRILL BITS FOR DRILLING IN A SUBTERRANEAN FORMATION AND METHODS RELATING THERETO

CROSS-REFERENCE TO RELATED APPLICATIONS

This application is a 35 U.S.C. § 371 national stage entry of PCT/US2014/068864, filed Dec. 5, 2014, and entitled "Drilling Systems and Hybrid Drill Bits for Drilling In a Subterranean Formation and Methods Relating Thereto," which claims the benefit of U.S. provisional application Ser. No. 61/912,302 filed Dec. 5, 2013, and entitled "Drilling Systems and Hybrid Drill Bits for Drilling in a Subterranean Formation," both of which are incorporated herein by reference in their entireties for all purposes.

STATEMENT REGARDING FEDERALLY SPONSORED RESEARCH OR DEVELOPMENT

Not applicable.

BACKGROUND

The present disclosure relates generally to drilling systems and earth-boring drill bits for drilling a borehole through a subsurface formation, for example, for the ultimate recovery of oil, gas, and/or minerals. More particularly, the present disclosure relates to hybrid drill bits including fixed blades with cutter elements in combination with rotating cones with cutting elements.

An earth-boring drill bit is connected to the lower end of a drill string and is rotated by rotating the drill string from the surface, with a downhole motor, or by both. With weight-on-bit (WOB) applied, the rotating drill bit engages the subsurface formation and proceeds to form a borehole along a predetermined path toward a target zone.

In drilling operations, costs are generally proportional to the length of time it takes to drill the borehole to the desired depth and location. The time required to drill the well, in turn, is greatly affected by the number of times drill bits must be changed or added during drilling operations. This is the case because each time a drill bit is changed or added, the entire string of drill pipes, which may be miles long, must be retrieved from the borehole, section-by-section. Once the drill string has been retrieved and the tool changed or added, the drillstring must be constructed section-by-section and lowered back into the borehole. This process, known as a "trip" of the drill string, requires considerable time, effort, and expense. Since drilling costs are typically on the order of thousands of dollars per hour, it is desirable to reduce the number of times the drillstring must be tripped to complete the borehole.

During conventional drilling operations, it is often necessary to change or replace the drill bit disposed at the lower end of the drill string once it has become damaged, worn, out and/or its cutting effectiveness has sufficiently decreased. Regardless of the specific motivations, each time the drill bit is replaced or changed, a trip of the drillstring must be performed which thus increases the overall time and costs associated with drilling the subterranean wellbore.

BRIEF SUMMARY OF THE DISCLOSURE

Some embodiments are directed to a drill bit for drilling a borehole in a subterranean formation, the borehole having a gauge diameter. In an embodiment, the drill bit includes a bit body having a bit axis, a first end configured to be coupled to a lower end of a drill string, and a second end configured to engage the subterranean formation, wherein the bit body includes a plurality of legs circumferentially disposed about the bit axis, wherein each leg has a lower section extending axially from the second end of the bit, and wherein each lower section has a leading surface relative to a direction of bit rotation about the bit axis and a trailing surface relative to the direction of bit rotation. In addition, the bit includes a plurality of rolling cone cutters, wherein each rolling cone cutter is rotatably mounted to the lower section of one of the legs and positioned along the leading surface of the corresponding leg, wherein each cone cutter has a cone axis of rotation that is radially spaced from the bit axis and is substantially perpendicular to a plane containing the bit axis. Each cone cutter includes a first plurality of cutter elements arranged in a first circumferential row extending about the corresponding cone axis of rotation. Each of the first plurality of cutter elements includes a planar cutting face that is configured to engage and shear the subterranean formation when the bit body is rotated about the bit axis in the direction of bit rotation.

Other embodiments are directed to a drill bit for drilling a borehole in a subterranean formation, the borehole having a gauge diameter. In an embodiment, the drill bit includes a bit body having a bit axis, a first end configured to be coupled to a lower end of a drill string, and a second end configured to engage the subterranean formation, wherein the bit body includes a plurality of legs circumferentially disposed about the bit axis, wherein each leg has a lower section extending axially from the second end of the bit, and wherein each lower section has a leading surface relative to a direction of bit rotation about the bit axis and a trailing surface relative to the direction of bit rotation. In addition, the drill bit includes a plurality of rolling cone cutters, wherein each rolling cone cutter is rotatably mounted on a journal threadably coupled the lower section of one of the legs, wherein each cone cutter is positioned along the leading surface of the corresponding leg. Each cone cutter includes a first plurality of cutter elements arranged in a first circumferential row extending about a corresponding cone axis of rotation. Each of the first plurality of cutter elements includes a planar cutting face that is configured to engage and shear the subterranean formation when the bit body is rotated about the bit axis in the direction of bit rotation.

Still other embodiments are directed to a method for drilling a borehole in a subterranean formation. In an embodiment, the method includes (a) removably coupling a first journal to a leg of a bit body, wherein the bit body has a bit axis. In addition, the method includes (b) rotatably coupling a first rolling cone cutter to the first journal, wherein the first cone cutter has a first cone axis and a plurality of cutter elements. Further, the method includes (c) rotating the drill bit about the bit axis in the cutting direction, and (d) engaging the subterranean formation with the plurality of cutter elements mounted to the first cone cutter during (c). Still further, the method includes (e) rotating the first cone cutter about the first cone axis during (d).

Embodiments described herein comprise a combination of features and advantages intended to address various shortcomings associated with certain prior devices, systems, and methods. The foregoing has outlined rather broadly the features and technical advantages of the disclosed embodiments in order that the detailed description that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the disclosed embodiments. It should also be realized by those skilled in the art that such equivalent constructions do not depart from the spirit and scope of the disclosure as set forth in the appended claims.

BRIEF DESCRIPTION OF THE DRAWINGS

For a detailed description of the disclosed embodiments, reference will now be made to the accompanying drawings in which.

DETAILED DESCRIPTION OF THE PREFERRED EMBODIMENTS

Figure 1:
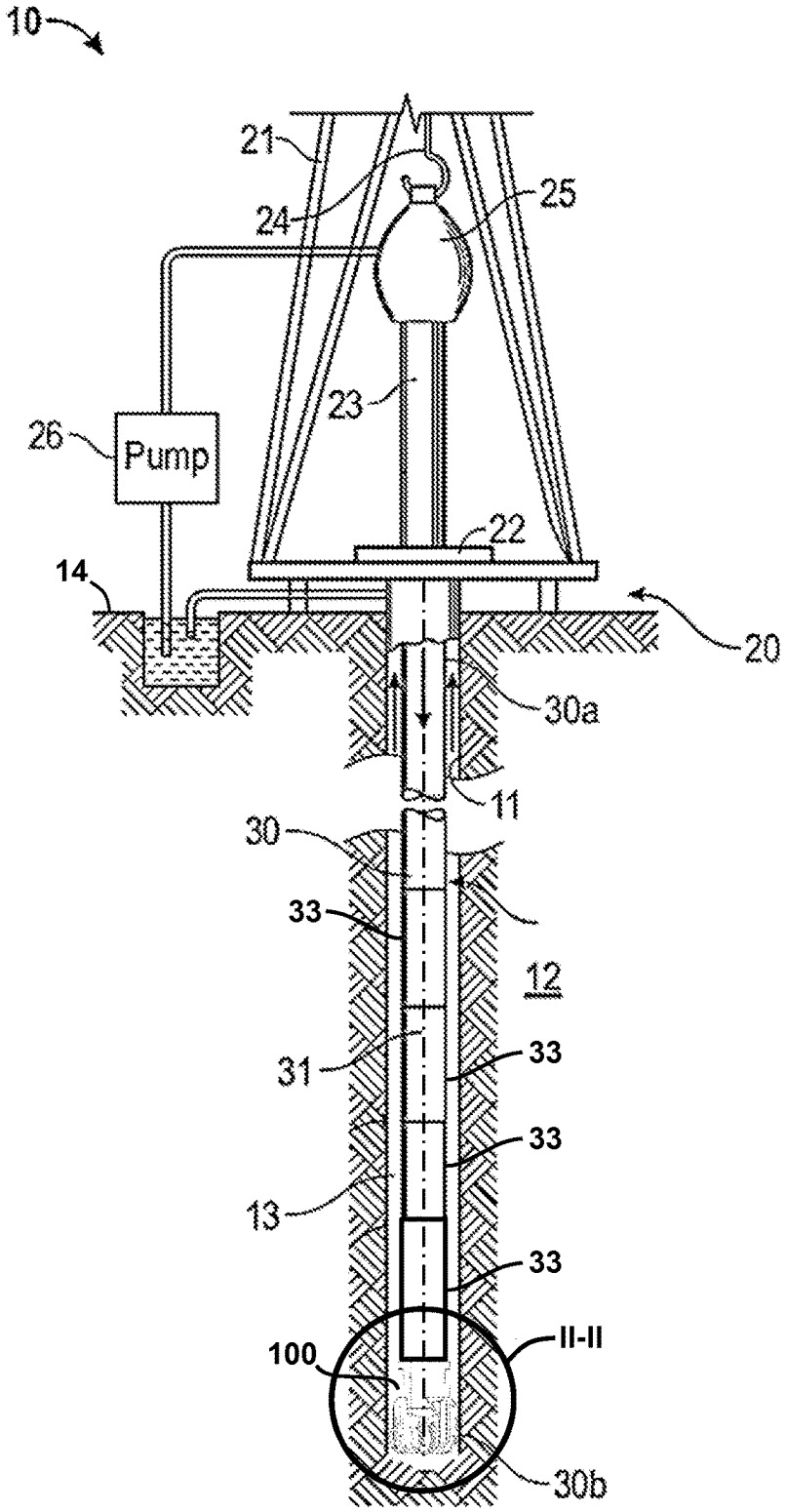
FIG. 1 is a schematic, partial side cross-sectional view of a drilling system including an embodiment of a drill bit in accordance with the principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This disclosure does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and in the claims will be made for purposes of clarity, with "up", "upper", "upwardly", "uphole", or "upstream" meaning toward the surface end of the borehole and with "down", "lower", "downwardly", "downhole", or "downstream" meaning toward the terminal end of the borehole, regardless of the borehole orientation.

As previously described, during conventional drilling operations, it is typically desirable to replace the drill bit that is engaging the earthen formation after the usable life of the bit has been exhausted. Each time such a bit replacement is performed the entire drillstring must be tripped to the surface, thus greatly increasing the costs of performing drilling operations. Accordingly, embodiments disclosed herein include drill bits comprising fixed blades having a plurality of cutter elements disposed thereon and rotating cones having a plurality of cutter elements disposed thereon to effectively increase the number of cutter elements and volume of cutting material available for engaging the subterranean formation during drilling operations.

Referring now to FIG. 1, an embodiment of a drilling system 10 is schematically shown. In this embodiment, drilling system 10 includes a drilling rig 20 positioned over a borehole 11 penetrating a subsurface formation 12 and a drillstring 30 suspended in borehole 11 from a derrick 21 of rig 20. Drillstring 30 has a central or longitudinal axis 31, a first or uphole end 30*a* coupled to derrick 21, and a second or downhole end 30*b* opposite end 30*a*. In addition, drillstring 30 includes a drill bit 100 at downhole end 30*b* and a plurality of pipe joints 33 extending from bit 100 to uphole end 30*a*. Pipe joints 33 are connected end-to-end, and drill bit 100 is connected to the lower end of the lowermost pipe joint 33. A bottomhole assembly (BHA) (not shown) can be disposed along drillstring 30 proximal drill bit 100 (e.g., axially between lowermost pipe joint 33 and drill bit 100).

In this embodiment, drill bit 100 is rotated by rotation of drillstring 30 from the surface 14. In particular, drillstring 30 is rotated by a rotary table 22 that engages a kelly 23 coupled to uphole end 30*a* of drillstring 30. Kelly 23, and hence drillstring 30, is suspended from a hook 24 attached to a traveling block (not shown) with a rotary swivel 25 which permits rotation of drillstring 30 relative to derrick 21. Although drill bit 100 is rotated from the surface 14 with rotary table 22 and drillstring 30 in this embodiment, in general, drill bit 100 can be rotated with a rotary table or a top drive disposed at the surface 14, a downhole mud motor disposed in a BHA, or combinations thereof (e.g., rotated by both rotary table via the drillstring and the mud motor, rotated by a top drive and the mud motor, etc.). For example, rotation via a downhole motor may be employed to supplement the rotational power of a rotary table 22, if required, and/or to effect changes in the drilling process. Thus, it should be appreciated that the various aspects disclosed herein are adapted for employment in each of these drilling configurations and are not limited to conventional rotary drilling operations.

During drilling operations, a mud pump 26 at the surface 14 pumps drilling fluid or mud down the interior of drillstring 30 via a port in swivel 25. The drilling fluid exits drillstring 30 through ports or nozzles in the face of drill bit 100, and then circulates back to the surface 14 through the annulus 13 between drillstring 30 and the sidewall of borehole 11. The drilling fluid functions to lubricate and cool drill bit 100, and carry formation cuttings to the surface 14.

Figure 2:
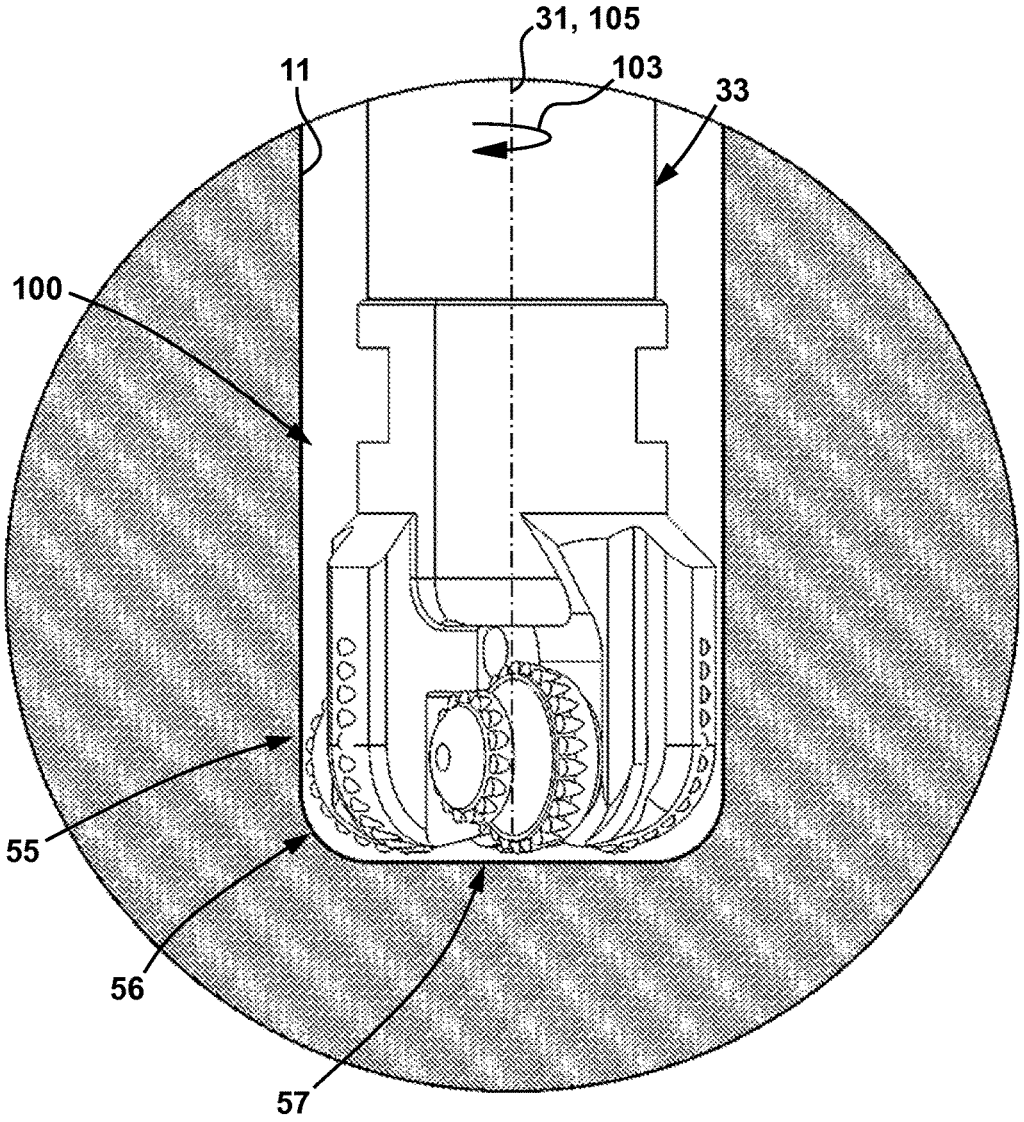
FIG. 2 is an enlarged, schematic partial side cross-section view of the drill bit and lower end of the drill string of the drilling system of FIG. 1 along section II-II.
Figure 3:
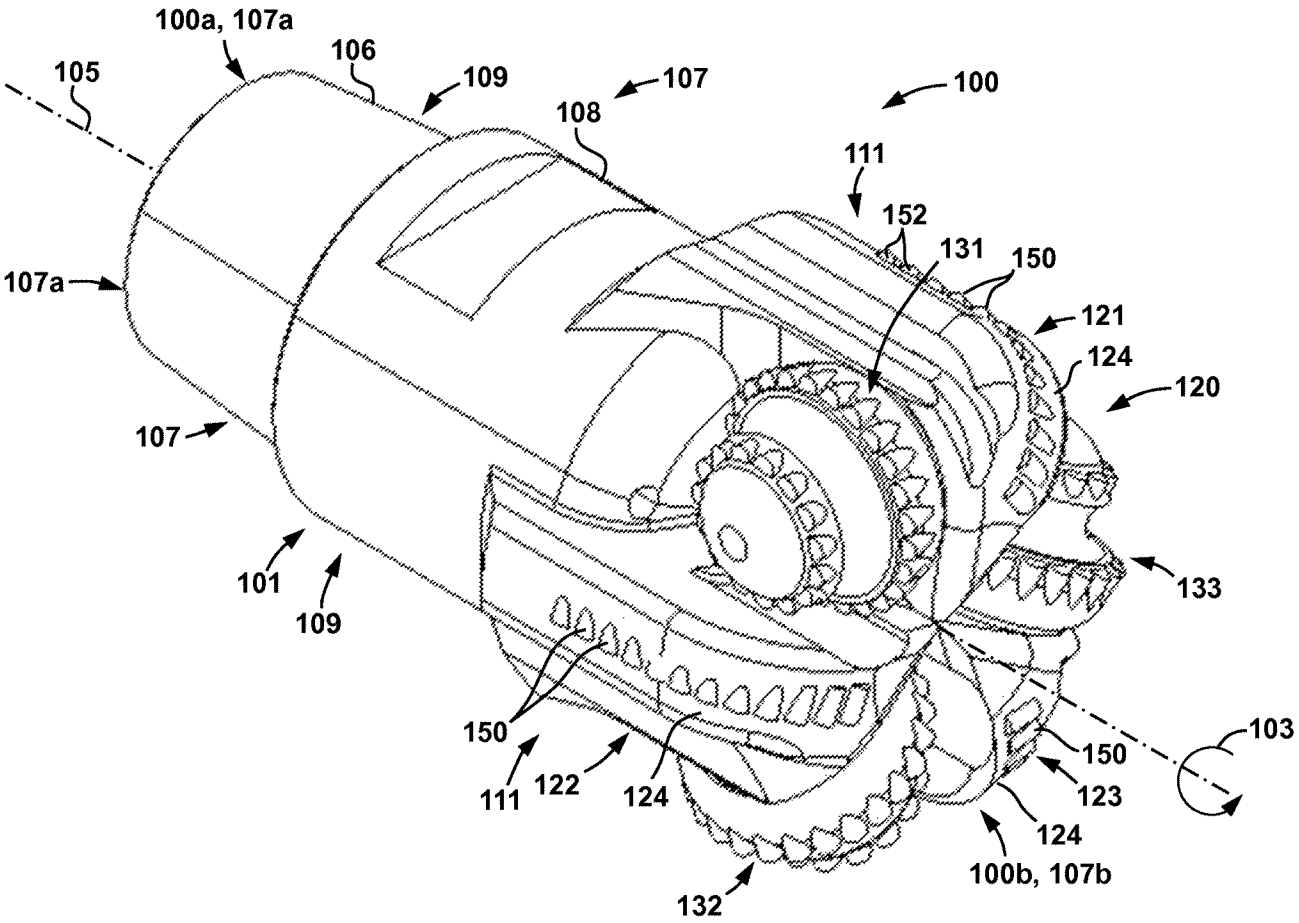
FIG. 3 is a perspective view of the drill bit of FIG. 1.
Figure 4:
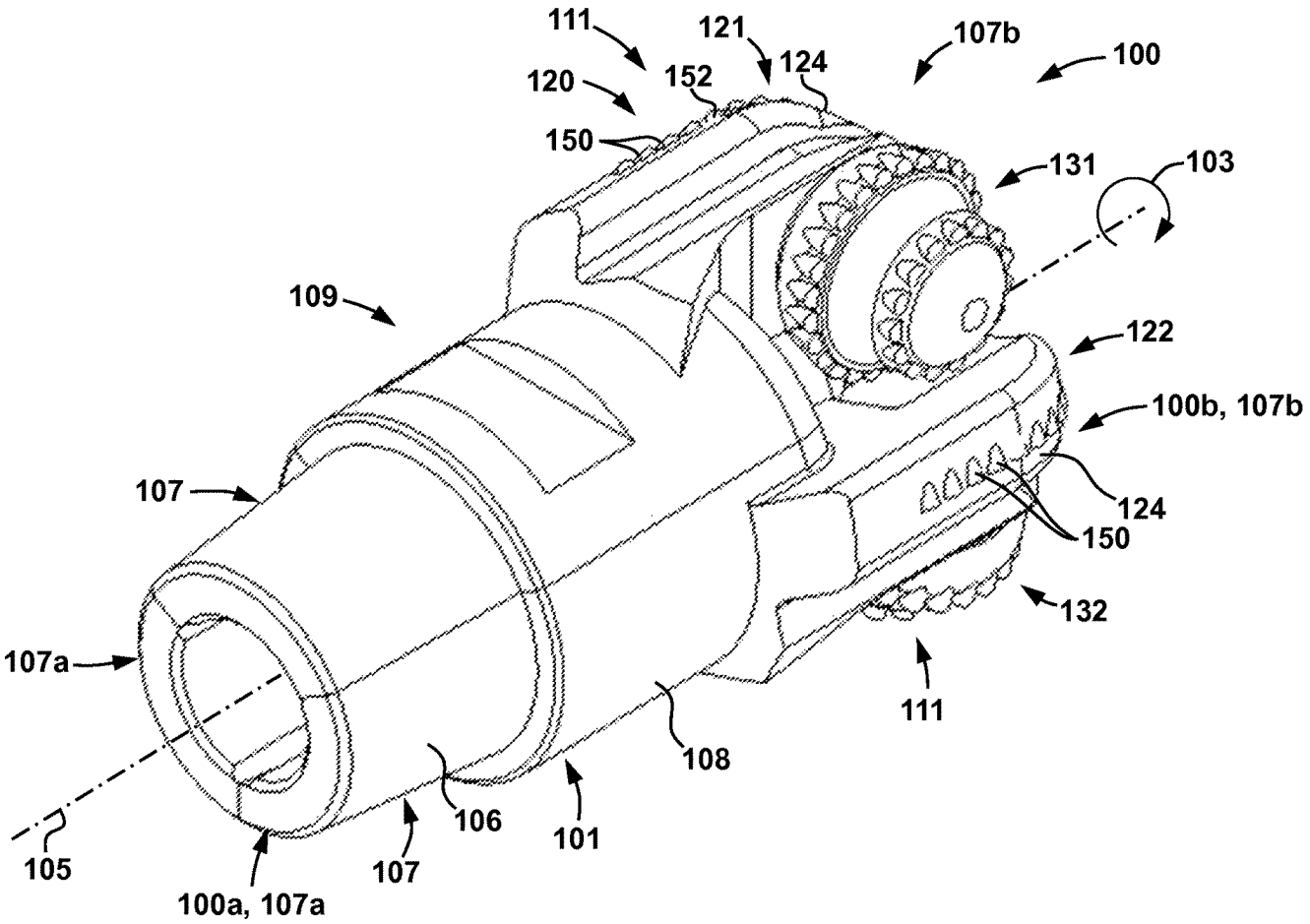
FIG. 4 is another perspective view of the drill bit of FIG. 1.
Figure 5:
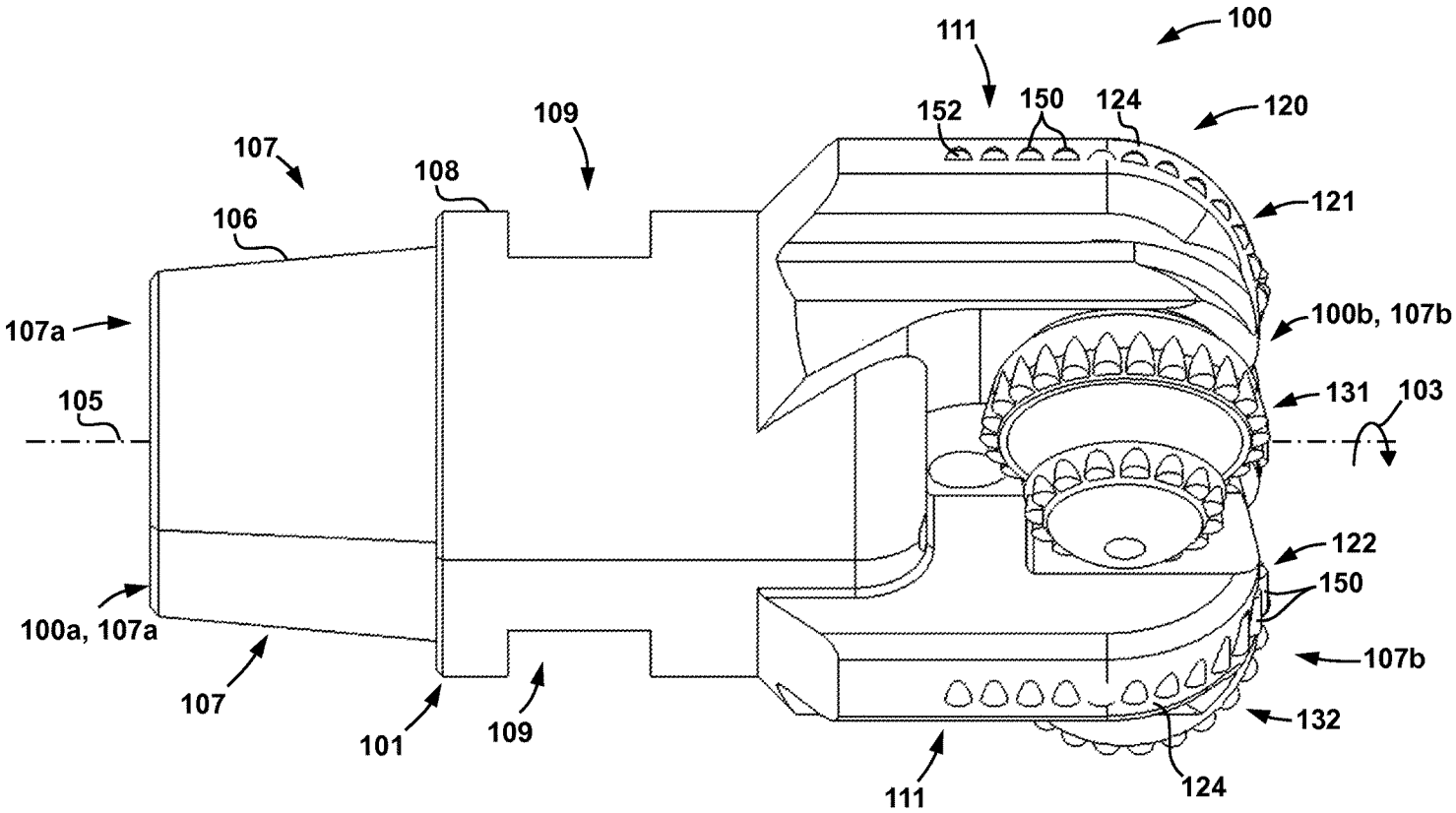
FIG. 5 is a side view of the drill bit of FIG. 1.

Referring briefly now to FIG. 2, the borehole 11 created by bit 100 includes sidewall 55, corner portion 56, and bottom 57. The mean effective stress around a borehole (e.g., borehole 11) is typically greatest at corner portion 56. Consequently, as compared to sidewall 55 and bottom 57 of borehole 11, corner portion 56 is generally harder and more difficult to cut. Thus, as will be explained in more detail below, embodiments disclosed herein include drill bits (e.g., bit 100) having rotating cone cutters with row(s) of cutter elements disposed thereon, thereby increasing the number of cutter elements available for engaging corner 56 of borehole 11 during drilling operations.

Referring now to FIGS. 3-7, drill bit 100 of system 10 is shown. Bit 100 has a central, longitudinal axis 105 about which bit 100 rotates in the cutting direction represented by arrow 103, a first or upper end 100*a*, and a second or lower end 100*b* opposite upper end 100*a*. In addition, bit 100 includes a bit body 101 having a threaded connection or pin 106 at upper end 100*a* for connecting bit 100 to drillstring 30, a cutting structure 120 at lower end 100*b* for engaging and cutting the formation (e.g., formation 12), and a shank 108 extending axially between pin 106 and cutting structure 120. Shank 108 provides a contact surface such that torqueing tools and/or assemblies may grip bit 100 to facilitate connection of bit 100 to drillstring 30.

Figure 7:
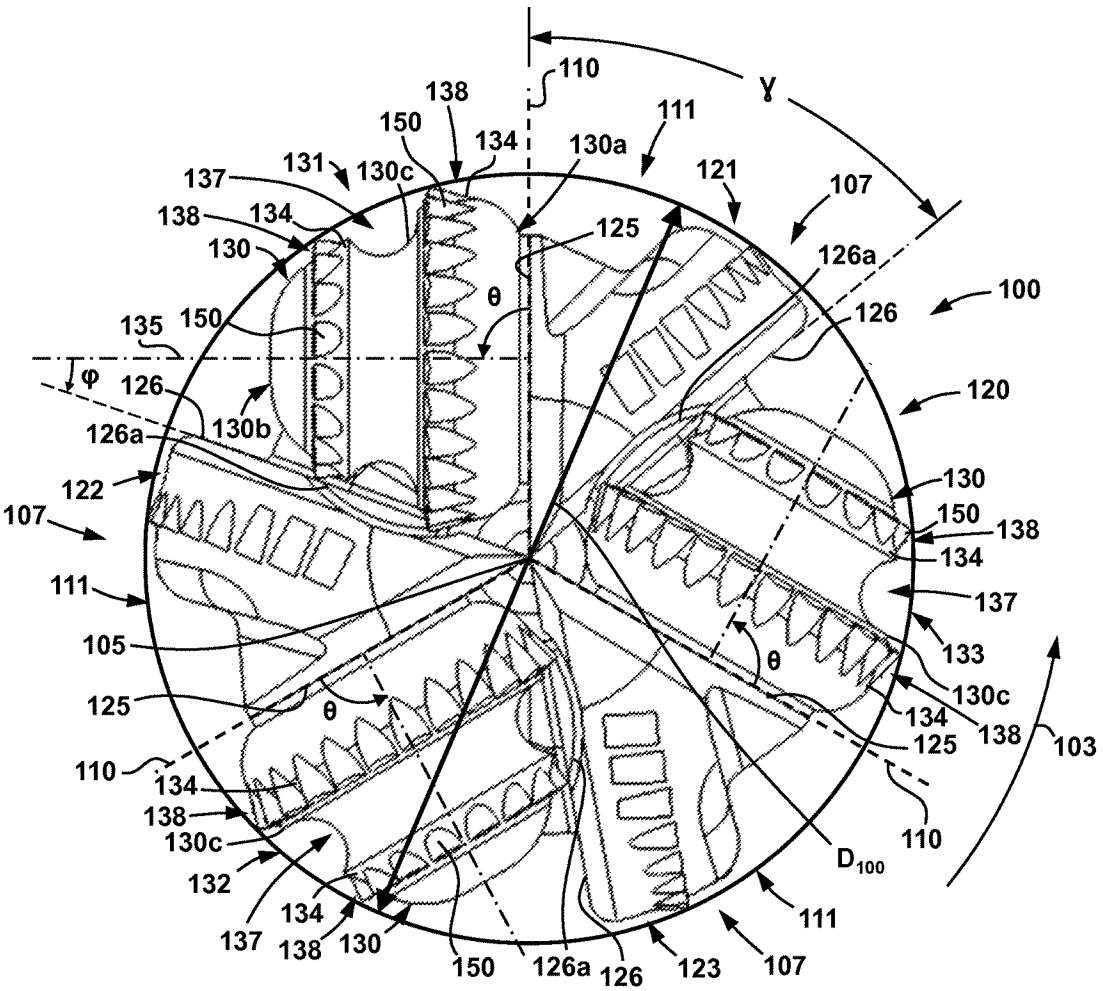
FIG. 7 is an end view of the drill bit of FIG. 1.

Bit 100 has a predetermined gauge diameter, defined by the radially outermost reach of three rolling cone cutters 131, 132, 133, which are rotatably mounted about their respective axes 135 on bearing shafts or journals that depend from the bit body 101, and three fixed blades 121, 122, 123 that depend from the bit body 101. FIG. 7 schematically illustrates the radially outer reach of bit 100 (relative to bit axis 105), as it is rotated in cutting direction 103 about axis 100, with a gauge circle 102 having a diameter $D_{100}$ equal to the full gauge diameter of bit 100. In this embodiment, circle 102 is concentrically disposed about bit axis 105.

Bit body 101 is composed of three circumferentially disposed sections or legs 107 that are welded together to form bit body 101. More specifically, each leg 107 has a first or upper end 107*a* coincident with end 100*a* of bit 100, a second or lower end 107*b* coincident with lower end 100*b* of bit 100, a first or upper section 109 extending axially from upper end 107*a*, and a second or lower section 111 extending axially from lower end 107*b* to the corresponding upper section 109. Upper sections 109 of legs 107 are welded together, whereas lower sections 111 are circumferentially-spaced apart. Each fixed blade 121, 122, 123 is integrally formed with (i.e., is monolithically formed with) the lower section 111 of a corresponding leg 107, and further, each fixed blade 121, 122, 123 extends radially outward from the lower section 111 of a corresponding leg 107. In particular, each of the blades 121, 122, 123 extend axially along the periphery of bit 100 and then radially along lower end 107*b* of one of the legs 107 toward axis 105, where legs 107 engage one another. In this embodiment, lower section 111 of each leg 107 includes one of the blades 121, 122, 123, and thus, a total of three circumferentially-spaced blades 121, 122, 123 are provided on bit 100.

In this embodiment, lower sections 111 are uniformly circumferentially-spaced apart and fixed blades 121, 122, 123 depending therefrom are uniformly circumferentially-spaced apart. Since there are three lower sections 111 and three corresponding fixed blades 121, 122, 123, lower sections 111 are uniformly angularly spaced 120° apart and blades 121, 122, 123 are uniformly angularly spaced 120° apart.

Figure 6:
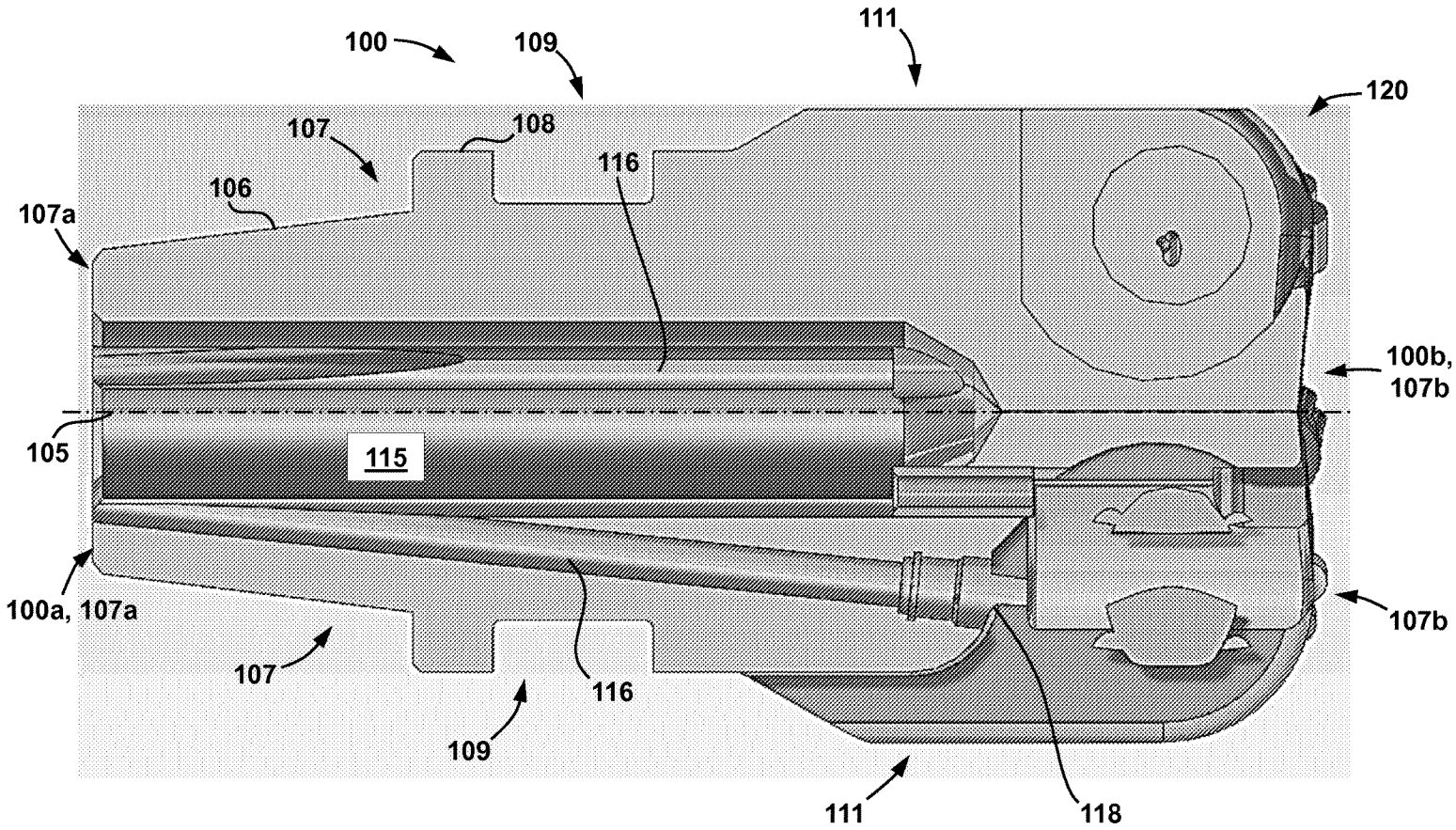
FIG. 6 is a cross-sectional side view of the drill bit of FIG. 1.

Referring briefly to FIG. 6, bit 100 also includes a central bore 115 extending axially from upper end 100*a* and a plurality of flow passages 116 extending downward from bore 115 to lower end 100*b*. Flow passages 116 have ports or nozzles 118 disposed at their lowermost ends (i.e., proximate end 100*b*). Bore 115, flow passages 116, and nozzles 118 facilitate the flow of drilling fluid from drillstring 30 (see FIG. 1) through bit 100. Nozzles 18 direct drilling fluid toward the bottom of the borehole (e.g., borehole 11) and around cone cutters 131, 132, 133 and blades 121, 122, 123. The drilling fluids emitted from nozzles 118 flush formation cuttings away from bit 100 as well as provide convective cooling to bit 100. While two passages 116 are shown in FIG. 6 it should be appreciated that, in other embodiments, more or less than two passages 116 are included while still complying with the principles disclosed herein.

Referring now to FIG. 7, lower section 111 of each leg 107 includes a radially extending leading face or surface 125 and a radially extending trailing face or surface 126. The surfaces 125, 126 on each leg 107 are described as "leading" and "trailing," respectively, since surface 125 leads surface 126 on the same leg 107 relative to the direction of rotation 103 of bit 100. Surfaces 125, 126 of each leg 107 are angularly spaced apart by an angle $\gamma$, and the trailing surface 126 of each leg 107 is oriented relative to the axis 135 of the immediately circumferentially adjacent cone cutter (e.g., cutters 131, 132, 133) that trails the trailing surface 126 with respect to the cutting direction 103 (i.e., the immediately adjacent trailing cone cutter) at the angle $\varphi$. In general, angle $\gamma$ is preferably between 0° and 90°, and more preferably between 30° and 60°. In this embodiment, each angle $\gamma$ is the same, and in particular, each angle $\gamma$ is 50°. In addition, in general the angle $\varphi$ is preferably between 0° and 45°, and more preferably between 0° and 30°. In this embodiment each angle $\varphi$ is the same, and in particular, each angle $\varphi$ is 20°. As will be described in more detail below, each of the cone cutters 131, 132, 133 is coupled to the lower section 111 of the corresponding leg 107 with a journal 140 and positioned along the leading surface 126 of the corresponding leg 107. Each trailing surface 126 includes a clearance recess 126*a*. As will be described in more detail below, clearance recess 126*a* in each leg 107 provides sufficient space and clearance to accommodate the rotation of the circumferentially adjacent trailing cone cutter 131, 132, 133 about its respective axis 135, and also provides sufficient space and clearance to allow the circumferentially adjacent trailing cone cutter 131, 132, 133 to be decoupled and removed from its corresponding leg 107.

Referring again to FIGS. 3-7, each blade 121, 122, 123 has a radially outer formation-facing cutter-support surface 124 that is circumferentially disposed between the leading surface 125 and trailing surface 126 of the lower section 111 of the corresponding leg 107. The formation-facing cutter-support surface 124 of each blade 121, 122, 123 supports a plurality of cutter elements 150 thereon. Cutter elements 150 include cutting faces 152, and are mounted in rows along support surfaces 124 of blades 121, 122, 123. It should be appreciated that in other embodiments, cutter elements 150 may be arranged in any other suitable arrangement in addition to rows while still complying with the principles disclosed herein. In this embodiment, cutting faces 152 of cutter elements 150 comprise polycrystalline diamond compact (PDC); however, it should be appreciated that cutter elements 150 and faces 152 may comprise a wide variety of materials and/or designs in other embodiments. In addition, it should also be appreciated that cutting faces 152 are planar. As best shown in FIG. 7, the radially outermost tips/edges of cutting faces 152 (relative to bit axis 105) of the radially outermost cutter element(s) 150 on each blade 121, 122, 123 (relative to bit axis 105) extend to the full gauge diameter $D_{100}$, and thus, touch gauge circle 102.

Figure 8:
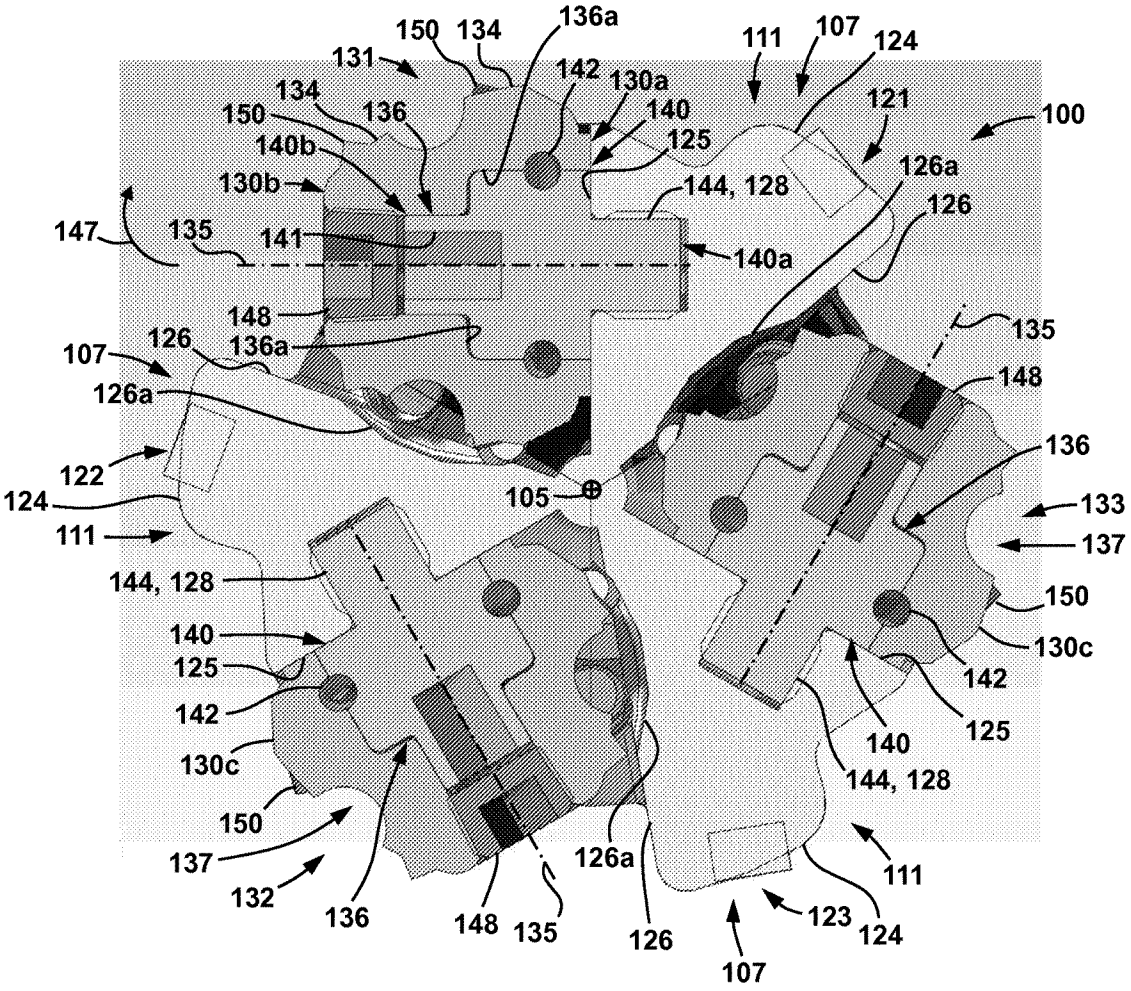
FIG. 8 is a cross-sectional end view of the drill bit of the drilling assembly of FIG. 1.
Figure 11:
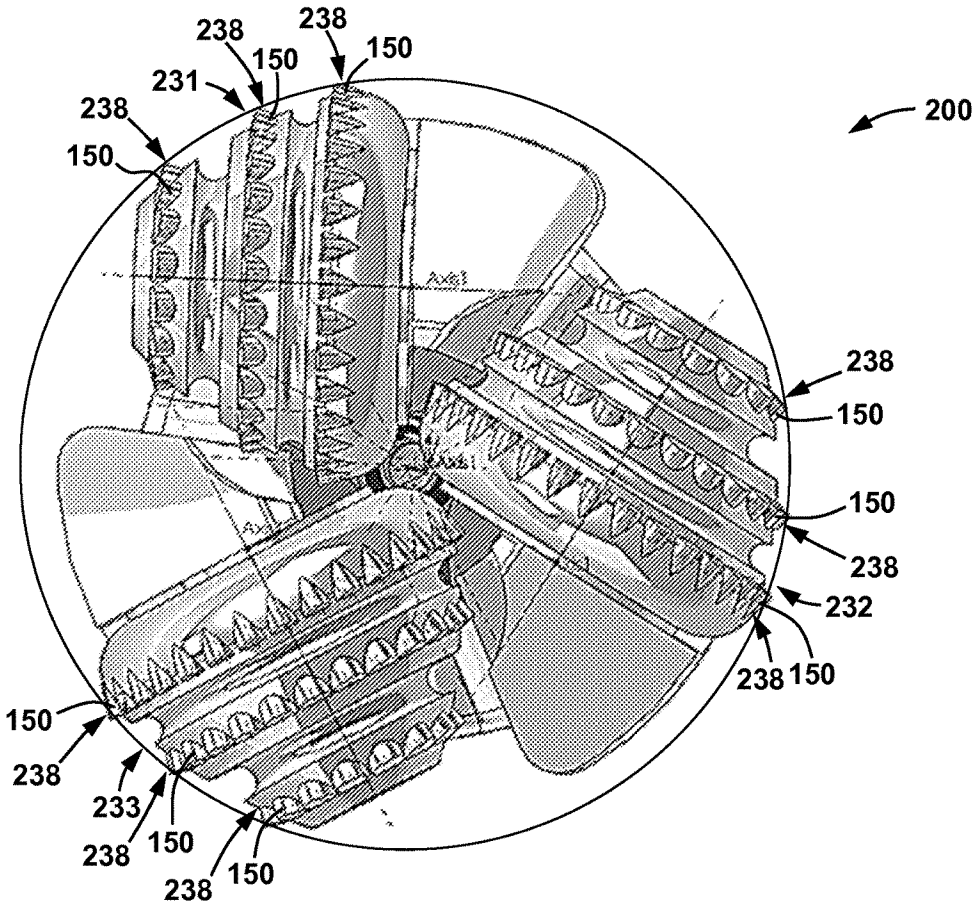
FIG. 11 is an end view of an embodiment of a drill bit in accordance with the principles disclosed herein.

Referring now to FIGS. 7 and 8, as previously mentioned above, each cone cutter 131, 132, 133 is mounted on a pin or journal 140 (see FIG. 8) extending from the leading surface 125 on the lower section 111 of one of the legs 107. In particular, each cone cutter 131, 132, 133 includes a generally conically shaped body 130 including a central axis of rotation 135, a first end or backface 130*a* adjacent the corresponding leg 107, a second end or nose 130*b* opposite the backface 130*a* and distal the corresponding leg 107, and a tapered or conical surface 130*c* extending axially from backface 130*a* to nose 130*b*. In this embodiment, conical surface 130*c* tapers generally radially inward toward axis 135 while extending axially from backface 130*a* to nose 130*b* such that each cone cutter 131, 132, 133 is radially wider at backface 130*a* then at nose 130*b*. As shown in FIG. 8, each axis 135 is radially spaced from the central axis 105 of bit 100. In other words, axes 135 do not intersect axis 105. The outer surface of body 130 of each cone 131, 132, 133 includes a plurality of axially spaced annular bands 134 extending circumferentially about axis 135 on surface 130*c*. Bands 134 define cutter supporting surfaces for mounting a plurality of cutter elements 150, which are substantially the same as the cutter elements 150 previously described. Thus, as is shown in FIG. 7, each of the cutter elements 150 on body 130 is axially spaced from the backface 130*a* along the axis 135. In this embodiment, a pair of cutter annular support surfaces 134 are provided on each cone 131, 132, 133, each surface 134 supporting an annular row 138 of cutter elements 150. Thus, in this embodiment, each cutter 131, 132, 133 includes two axially spaced annular rows 138 of cutter elements 150 thereon. However, it should be appreciated that in other embodiments, more or less than two rows 138 of cutter elements 150 may be included on body 130 of each cutter 131, 132, 133 while still complying with the principles disclosed herein. For example, referring briefly to FIG. 11, where a bit 200 including embodiments of rotating cones 231, 232, 233 having a total of three axially spaced rows 238 of cutter elements 150 is shown. Referring again to FIG. 7, the radially outermost tips/edges of cutting faces 152 (relative to bit axis 105) of the radially outermost cutter element(s) 150 (relative to bit axis 105) in each row 138 on each cone cutter 131, 132, 133 extend to the full gauge diameter $D_{100}$, and thus, touch gauge circle 102. Referring again to FIGS. 7 and 8, a circumferential groove or "junk slot" 137 extends radially into body 130 and circumferentially about the axis 135 of each cutter 131, 132, 133. During drilling operations, cuttings sheared from the formation (e.g., formation 12) by cutter elements 150 are directed into the junk slot 137 before being swept away from cutting structure 120 by drilling fluids (e.g., drilling mud). In this embodiment slot 137 is axially positioned between each of the bands 134, previously described, with respect to the central axis 135.

Referring specifically to FIG. 8, in this embodiment, body 130 of each cutter 131, 132, 133 includes a central passage 136 extending axially therethrough from backface 130*a* to nose 130*b*. Each passage 136 is defined by an internal surface 136*a* extending axially from backface 130*a* to nose 130*b* of the corresponding cone 131, 132, 133. Each journal 140 is disposed within passage 136 of the corresponding cone 131, 132, 133 and includes a first or proximal end 140*a*, a second or distal end 140*b* opposite the proximal end 140*a*, an engagement receptacle 141 extending axially from distal end 140*b*, and a threaded connector 144 at proximal end 140*a*. In this embodiment, each journal 140 is secured within passage 136 by locking balls 142 in a conventional manner, as described and shown, for example, in U.S. Pat. No. 8,020,638, which is incorporated herein by reference in its entirety. Balls 142 also support the rotation bodies 130 about axes 135 relative to journals 140 during drilling operations. It should also be appreciated that in some embodiments, additional bearing mechanisms (e.g., roller bearings) (not shown) may be placed along the journal 140 and surface 136*a* to further support the rotation of bodies 130 about the axes 135 during operations. A seal cap 148 is threadably secured within each passage 136 proximate nose 130*b* to seal off passage 136 and, in some embodiments, provide an injection port for the injection of a lubricant (e.g., grease) within passage 136 during operations. It should be appreciated that in some embodiments, additional sealing assemblies (e.g., rotary seals) may be included within passage 136 to further restrict the flow of fluid (e.g., lubricant, drilling fluid, etc.) out from or into the passage 136 during drilling operations. For example, in some embodiments, additional seal glands are included on either the internal surface 136*a* or the journal 140 while still complying with the principles disclosed herein. During assembly of bit 100, each journal 140 is received within a passage 136 of one of the cutters 131, 132, 133 in the manner previously described, and is further mounted to lower section 111 of one of the legs 107. In particular, connector 144 on each journal 140 is threadably received within a port 128 extending into leading surface 125 of lower section 111 of one of the legs 107 to secure journal 140 and thus body 130 thereto. As a result, each cutter 131, 132, 133 is free to rotate about its respective axis 135 during operations.

Due to the threaded engagement of each journal 140 within a port 128 extending into leading surface 125 on lower section 111 of one of the legs 107, journals 140 are removably mounted to lower section 111 of each leg 107 such that the cone cutters 131, 132, 133 can be readily removed from bit 100 along with its corresponding journal 140. In other words, each journal 140 and corresponding cone cutter 131, 132, 133 can be decoupled and removed from the corresponding leg 107 by unthreading the journal 140 from the leg 107. As a result, upon failure or exhaustion of the usable life of the cutter elements 150 on cutters 131, 132, 133, an operator can trip bit 100, remove and replace cones 131, 132, 133 via unthreading and threading, respectively, journals 140 from ports 128, thereby enabling drilling operations to resume without a relatively expensive replacement of the entire bit 100 and without damaging the journals 140 or bit 100.

For example, the specific removal procedures for cone cutter 131 mounted to the lower section 111 of one of the legs 107 will now be described; however, it should be appreciated that these procedures are the same for each of the other cone cutters 132, 133 on the other legs 107. Specifically, when it is desired to remove cone cutters 131 from the lower section 111 of the corresponding leg 107, seal cap 148 is removed from passage 136, thereby allowing access to engagement receptacle 141. Receptacle 141 includes an inner profile that is sized and shaped to receive a mating wrench or other tool for transferring torque to journal 140 during installation and removal procedures. In this embodiment the inner profile of receptacle 141 includes a plurality of planar surfaces extending axially along the respective axis 135 from distal end 140*b*. During these operations, following removal of seal cap 148, a wrench or other suitable tool (e.g., a tool that is shaped and sized to correspond with the planar surfaces making up receptacle 141) is inserted within receptacle 141 and thereafter transfers torque about axis 135 to unthread journal 140 from leading surface 125. As journal 140 is unthreaded from leading surface 125 axial movement cone cutter 131 along axis 135 is accommodated by clearance recess 126*a* on the immediate circumferentially adjacent leading leg 107 (i.e., on the immediately adjacent leading leg 107 with respect to cutting direction 103). In this embodiment, axial movement of cone cutter 131 is also accommodated by the arrangement of leading surface 125 on the corresponding leg 107 relative to the trailing surface 126 on the immediately adjacent leading leg 107 at the angle φ as previously described. In addition, in this embodiment, once journal 140 is fully unthreaded from leading surface 125, cone cutter 131 is rotated relative to the corresponding leg 107 along direction 147 in order to remove both cutter 131 and journal 140 from bit 100. This rotation along direction 147 is also accommodated by clearance recess 126*a* such that cutter elements 150 on cone cutter 131 are prevented from engaging with trailing surface 126 on circumferentially adjacent blade 122. As a result, due to the threaded engagement of journal 140 and size, shape, and arrangement of clearance recess 126*a* on leading surface 126 of the immediately adjacent leading leg 107 relative to the size, shape, and arrangement of leading surface 125 on the corresponding leg 107, cone cutter 131 is readily removable from the corresponding leg 107 on bit 100 such that it may be repaired and/or replaced to facilitate subsequent drilling operations with bit 100. Installation procedures for cone cutter 131 on the corresponding leg 107 of bit 100 are simply the reverse of the operations listed above for the removal of cone cutter 131, and thus, a detailed description of this procedure is omitted.

Figure 9:
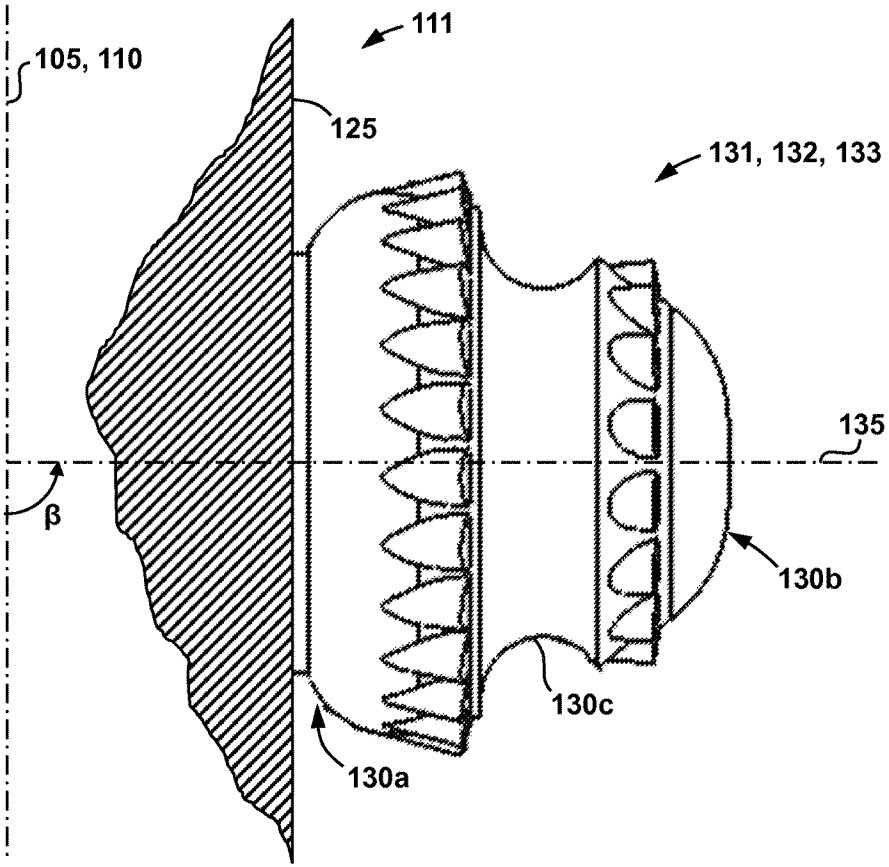
FIG. 9 is a side view of one of the rotatable cutters of the drill bit of FIG. 1.

Referring again to FIG. 7, each central axis 135 of cone cutters 131, 132, 133 is oriented at an angle θ with respect to a corresponding plane 110 oriented parallel to and containing axis 105 when bit 100 is viewed along the axis 105. In general, each angle θ preferably ranges from 60° to 120°, and is more preferably approximately 90° (i.e., 90° plus/minus 5°). In this embodiment, each angle θ is 90°. Thus, in this embodiment, axis 135 of each cone cutter 131, 132, 133 is parallel to the cutting direction 103 of bit 100 at the corresponding plane 110 (i.e., axis 135 is parallel to a tangent line of the circle defined by cutting direction arrow 103 as shown in FIG. 7). In addition, referring now to FIG. 9, each of cutter 131, 132, 133 is mounted to leading surface 125 of the corresponding leg 107 such that its central axis 135 is oriented at an angle β with respect to plane 110 when viewing bit 100 radially or from a point disposed along a radius of axis 105. In general, the angle β preferably ranges from 60° to 120°, and is more preferably approximately 90° (i.e., 90° plus/minus 5°). As is shown in both FIGS. 7 and 9, in this embodiment, each cutter 131, 132, 133 is arranged such that backface 130*a* of each cutter 131, 132, 133 is more proximate the corresponding plane 110 than nose 130*b*, and further, each backface 130 is parallel to the corresponding plane 110.

Figure 10A:
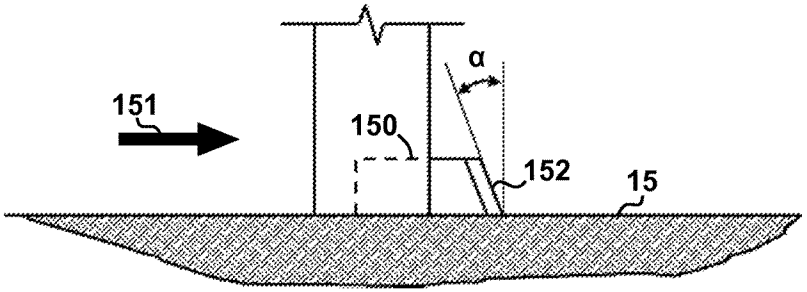
FIGS. 10*a*-10*c* are schematic side views illustrating exemplary cutter elements engaging the formation at various degrees of backrake.
Figure 10B:
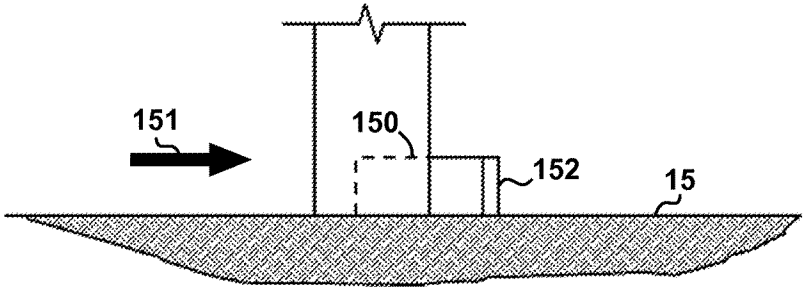
Figure 10C:
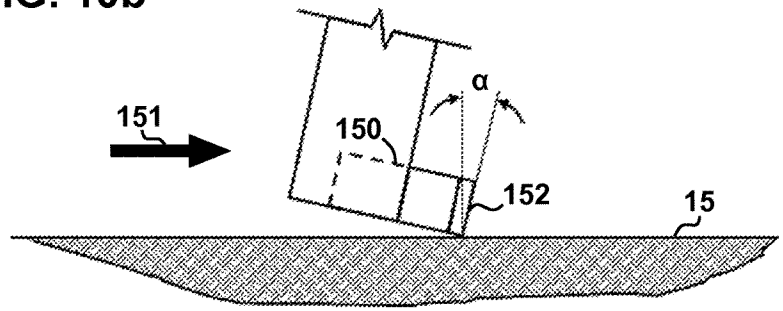

In some embodiments, the orientation of the cutting face 152 of each of the cutter elements 150 on one or more of the blades 121, 122, 123 and/or cutters 131, 132, 133 may be designed or arranged to enhance the durability and useful life thereof during drilling operations. For example, referring now to FIGS. 10*a*-10*c*, where three exemplary cutter elements 150 are shown oriented with different backrake angles as they are moved or drug in the direction of arrow 151 across a surface 15 (e.g., the surface of the formation). As used herein, the "backrake angle" of a cutting face of a cutter element refers to the angle α formed between the cutting face (e.g., cutting face 152) and a line that is normal to the surface of the formation material being cut (e.g., surface 15). As shown in FIG. 10*b*, when the backrake angle α is zero, the cutting face 152 is substantially perpendicular to surface 15. As shown in FIG. 10*a*, when the cutting face 152 is oriented at an angle greater than 90° with respect to surface 15, the backrake angle α is negative. As shown in FIG. 10*c*, when the cutting face 152 is oriented at an angle that is less than 90° with respect to surface 15, the backrake angle α is positive.

Generally speaking, the greater the backrake angle α, the less aggressive the cutter element and the lower the loads experienced by the cutter element 150. Consequently, where the cutting faces 152 of two cutter elements 150 each have a negative backrake angle α, the cutter element 150 with the more negative backrake angle α is more aggressive; and where the cutting faces 152 of two cutter elements 150 each have a positive backrake angle α, the cutter element 150 with the larger backrake angle α is less aggressive. In addition, where the cutting face 152 of one cutter element 150 has a negative backrake angle α and the cutter face 152 of another cutter element 150 has a positive backrake angle α, the cutter element 150 with the negative backrake angle α is more aggressive. Thus, if all other factors are ignored, the cutter element 150 shown in FIG. 10*a* experiences greater loads than the cutter element shown in FIG. 10*b*, and the cutter element 150 shown in FIG. 10*b* experiences greater loads than the cutter element 150 shown in FIG. 10*c* when each cutter element 150 is moved or drug across the surface 15 in direction 151. Because embodiments of the drill bit (e.g., bit 100) disclosed herein include an increased number of available cutter elements 150 that are exposable to the subterranean formation during operations, the angles θ, β may be chosen to provide a more aggressive backrake angle α for at least some of the cutter elements 150 while still maintaining a sufficient usable life. In addition, because each of the rotating cutters 131, 132, 133 is readily removable and replaceable on bit 100, whereas the fixed blades 121, 122, 123 are not readily removable and replaceable, in some embodiments, the cutter elements 150 disposed on the fixed blades 121, 122, 123 may be configured to have a less aggressive backrake angle α (to facilitate enhanced durability) while the cutter elements 150 disposed on the rotating cutters 131, 132, 133 may be configured to have a more aggressive backrake angle α (since they can be replaced). Further, referring briefly again to FIG. 2, in some embodiments, the backrake angle (e.g., angle α) of each of the cutter elements 150 on the rotating cutters 131, 132, 133 is adjusted (e.g., by altering the angles θ and β previously described and shown in FIGS. 7 and 8 and adjusting the axial spacing of the cutter elements 150 from the backface 130*a* along the axes 135) such that as each cutter 131, 132, 133 rotates about its respective axis 135, the cutter elements 150 successively engage the sidewall 55, the corner portion 56, and finally the bottom 57 of borehole 11.

Referring now to FIGS. 1-5, 7, and 8, during drilling operations, drill bit 100 is rotated about the aligned axes 31, 105 in direction 103 such that cutter elements 150 disposed on each of the blades 121, 122, 123, and cutters 131, 132,133 engage with the formation 12 to lengthen borehole 11. As bit 100 is rotated in the manner described, cutters 131, 132, 133 also rotate about their respective axes 135 (see FIGS. 7 and 8) to expose each of the cutter elements 150 extending from surface 134 to the subterranean formation 12. In at least some embodiments, cutters 131, 132, 133 are placed on bit 100 such that cutter elements 150 disposed thereon engage with corner 56 of borehole 11, thereby increasing the total number of cutter elements 150 that are exposed to corner 56 during drilling operations. During these drilling operations, it should be appreciated that cutter elements 150 on cutters 131, 132, 133 engage with formation 12, such that cutting faces 152 shear off portions thereof to lengthen borehole 11. This sort of shearing contact between cutter elements 150 and formation 12 is fundamentally different from the contact achieved by the cutter elements (e.g., inserts, milled teeth, etc.) disposed on a conventional rolling cone bit, which are instead configured to pierce, gouge, and crush the formation (e.g., formation 12).

While a specific arrangement for rotatably mounting each of the cone cutters 131, 132, 133 to lower section 111 of each leg 107 is shown in FIG. 8, it should be appreciated that other arrangements are possible. For example, in some embodiments, a bearing race is installed within the recess 136 to support radially oriented loads (with respect to axis 135) exerted on cutters 131, 132, 133 as well as rotational motion of body 130 of each cutter 131, 132, 133 about their respective axes 135 during operations. In particular, referring now to FIG. 12 where an embodiment of bit 100 (shown and described as bit 100A) is shown. Bit 100A is substantially the same as bit 100 previously described, except that a bearing race 160 is installed within passage 136 of body 130 of each rotating cutter 131, 132, 133. Race 160 is generally cylindrical in shape and includes a first or proximal end 160*a*, a second or distal end 160*b*, and an external cylindrical surface 164 extending between the ends 160*a*, 160*b*. In addition, race 160 includes a plurality of pins 166 extending axially from proximal end 160*a*. In this embodiment, pins 166 are generally cylindrical in shape; however, the exact shape and proportions of pins 166 may be greatly varied while still complying with the principles disclosed herein. Further, while only two pins 166 are shown in FIG. 12, it should be appreciated that the number of pins 166 as well as their placement along race 160 may also be varied while still complying with the principles disclosed here.

Figure 12:
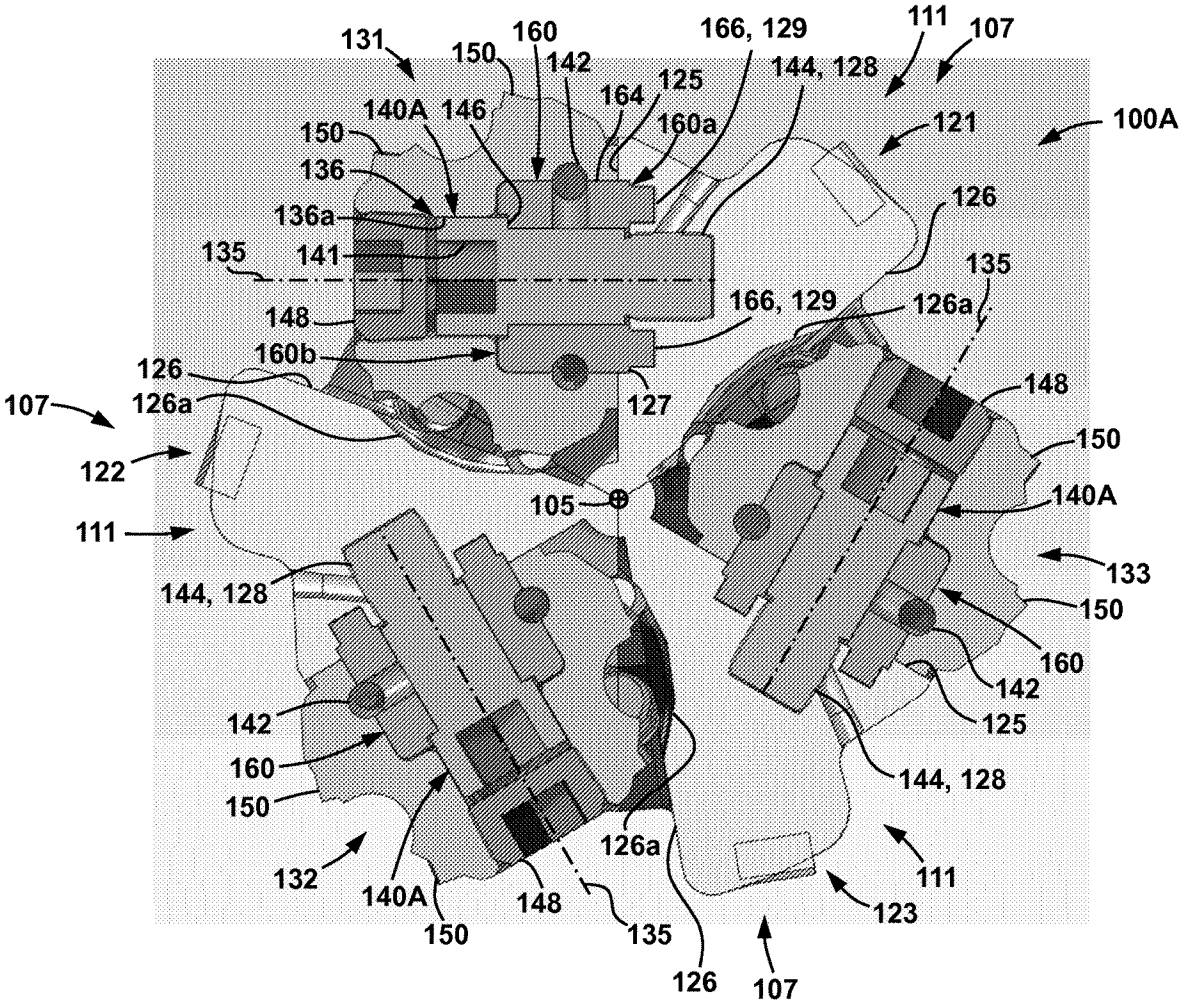
FIG. 12 is cross-sectional end view of an embodiment of a drill bit in accordance with the principles disclosed herein.

Referring still to FIG. 12, bit 100A also includes a journal 140A that is substantially the same as journal 140, previously described, that except that journal 140A is sized and proportioned to fit within bearing race 160 when it is installed within passage 136 of body 130 (i.e., journal 140A is generally radially smaller or narrower than journal 140). In addition, due to the generally radially narrower shape of journal 140A as compared to journal 140, an annular shoulder 146 is formed between the ends 140*a*, 140*b*.

During assembly, race 160 is slipped over journal 140A such that distal end 160*b* engages or abuts annular shoulder 146. Thereafter both journal 140A and race 160 are installed within passage 136 of body such that outer cylindrical surface 164 of race 160 slidingly engages internal surface 136*a*. In addition, race 160 and journal 140A are secured within passage 136 through engagement of locking balls 142 in the same manner as previously described above for journal 140 of bit 100 (see FIG. 8). Thereafter, threaded connector 144, previously described, on journal 140A is threadably engaged within port 128 in the same manner as previously described above for bit 100. In addition, as journal 140A is threadably secured to leading surface 125 on lower section 111 of one of the legs 107 as described above, annular shoulder 146 engages distal end 160*b* such that proximal end 160*a* is seated within a groove 127 extending within lower leading surface 125 of section 111. In addition, as proximal end 160*a* is seated within groove 127, each of the pins 166 are seated within one of a plurality of corresponding counterbores 129 extending within groove 127. In this embodiment, each of the counterbores 129 are arranged and sized to correspond with the pins 166 on race 160. Thus, during drilling operations, as body 130 rotates about axis 135, race 160 transfers radially directed loads with respect to axis 135 to the other portions of bit 100A through engagement of race 160 and groove 127. In addition, race 160 is rotatably fixed with respect to bit 100A through engagement of pins 166 and counterbores 129.

Figure 13:
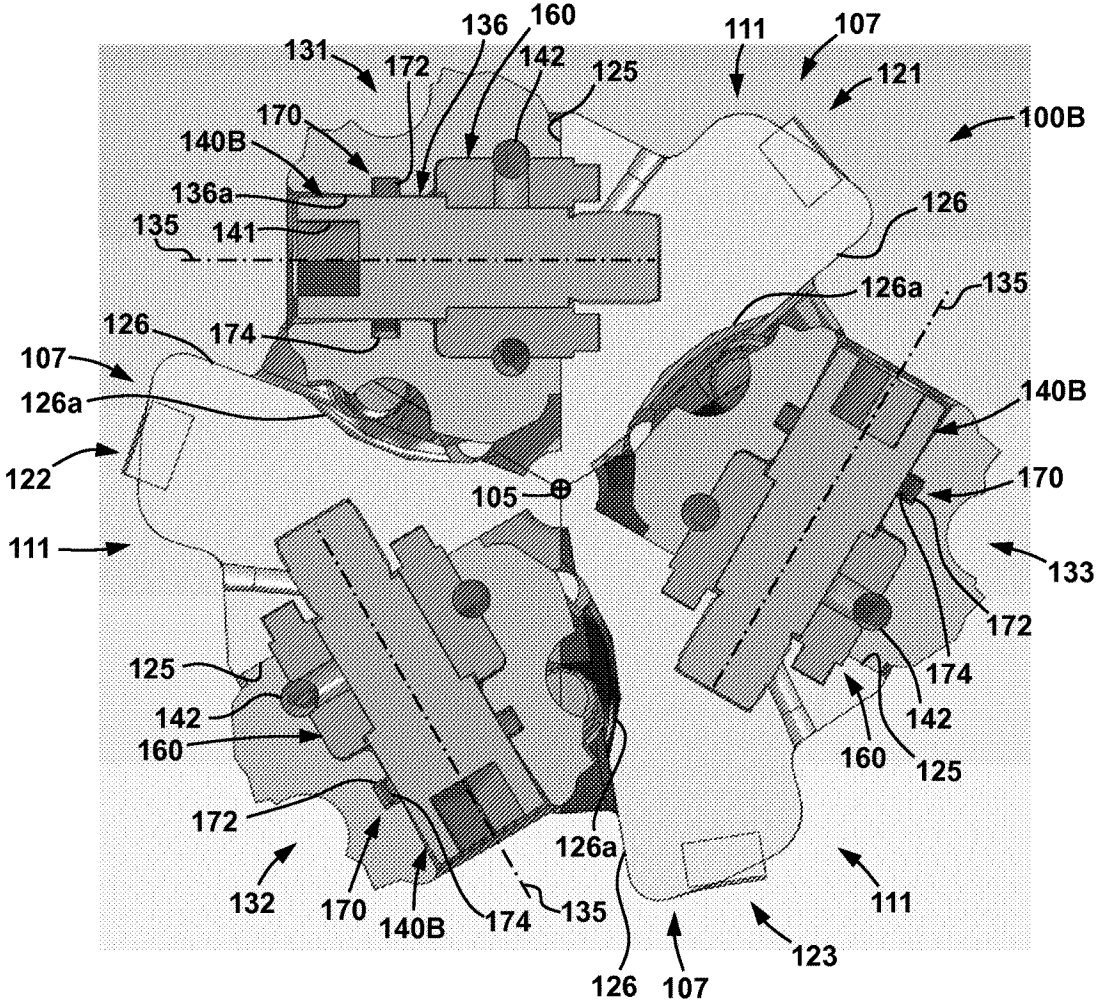
FIG. 13 is a cross-sectional end view of an embodiment of a drill bit in accordance with the principles disclosed herein.

In addition, in some embodiments, no separate seal cap 148 is included to reduce the total number of components. For example, referring now FIG. 13, where an embodiment of bit 100 (shown and described as bit 100B) is shown. Bit 100B is substantially the same as bit 100A previously described, except that no seal cap 148 is included to seal off inner passage 136 during operations. Instead, a seal assembly 170 is included to effectively seal off passage 136 from the downhole environment. In particular, assembly 170 includes an annular seal gland 172 extending circumferentially along surface 136*a* and a seal member 174 disposed within gland 172. In some embodiments, seal member 174 comprises an O-ring or any other suitable rotary seal; however, any sealing member suitable for restricting and/or preventing fluid flow between engaged surfaces may be utilized while still complying with the principles disclosed herein. In addition, bit 100B also includes a journal 140B that is substantially the same as journal 140A previously described except that journal 140B is axially elongated such that it extends to a point that is proximate the nose 130*b* of body 130. During operations, when journal 140B and race 160, previously described, are received within passage 136, seal member 174 engages both journal 140B and gland 172 such that a static seal is formed between gland 172 and member 174 and a dynamic seal is formed between member 174 and journal 140B to effectively seal off the passage 136 from the downhole environment.

In the manner described, embodiments of drill bits described herein (e.g., bits 100, 100A, 100B, 200), the number of cutter elements 150 that are exposable to the formation 12 (particularly to corner 56) are greatly increased. As a result, the usable life of a bit designed in accordance with the principles disclosed herein is increased such that the time between necessary trips of the drill string 31 to replace and/or repair the drill bit is also greatly increased, thereby reducing the overall costs of drilling operations. In addition, because the journals 140, 140A, 140B and thus cutters 131, 132, 133 are removably coupled to bit 100, 100A, 100B, respectively, in the manner described above, an operator may simply replace the cone cutters 131, 132, 133 upon failure or exhaustion of the useable life of the cutter elements 150 disposed thereon, thereby further reducing the overall costs of drilling operations.

While embodiments disclosed herein have included legs 107 with lower sections 111 that meet or engage one another at the axis 105, it should be appreciated that in other embodiments, lower sections 111 may not meet or engage one another in this manner and may instead each terminate at a point that is radially spaced from axis 105 while still complying with the principles disclosed herein. In addition, it should be appreciated that in some embodiments, more or less than three fixed blades 121, 122, 123 are included on bit 100 while still complying with the principles disclosed herein. Further, while embodiments shown and described herein have included blades 121, 122, 123 that each include cutter elements 150, it should be appreciated that in some embodiments (e.g., see bit 200 in FIG. 11) no cutter elements 150 are included on one or more of the fixed blades 121, 122, 123 while still complying within the principles disclosed herein. Still further, while embodiments disclosed herein have included journals 140, 140A, 140B that are removably coupled to bit 100, 100A, 100B, respectively, it should be appreciated that other embodiments include journals that are integrally formed with the bit (e.g., bit 100, 100A, 100B, 200) while still complying with the principles disclosed herein. For example, some embodiments include journals (e.g., journals 140, 140A, 140B) that are welded to the lower section 111 of one of the legs 107. Also, in some embodiments, the number and arrangement of the rows of cutter elements 150 on each cutter 131, 132, 133 may be designed such that cutters 131, 132, 133 may engage one or more of the sections 55, 56, 57 of the borehole 11 during drilling operations. It should also be appreciated that in some embodiments, conventional roller bearings may be used to support the rotation of each of the cutters 131, 132, 133 about the relative axes 135 either in addition to or in lieu of the specific support mechanisms described above, while still complying with the principles disclosed herein. It should further be appreciated that in some embodiments, conventional oil bladders (or similar such devices) may be used to supply lubricant (e.g., oil, grease) to the cutters 131, 132, 133 in order to further facilitate their rotation about the axes 135 during drilling operations.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of this disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A drill bit for drilling a borehole in a subterranean formation, the borehole having a gauge diameter, the drill bit comprising:

a bit body having a bit axis, a first end configured to be coupled to a lower end of a drill string, and a second end configured to engage the subterranean formation, wherein the bit body includes a plurality of legs circumferentially disposed about the bit axis, wherein each leg has a lower section extending axially from the second end of the bit body, wherein the lower section of each leg is circumferentially-spaced apart from each circumferentially adjacent lower section, and wherein each lower section has a leading surface relative to a cutting direction of bit rotation about the bit axis, a trailing surface relative to the cutting direction, and a radially outer surface extending circumferentially from the leading surface to the trailing surface of the corresponding lower section;

a plurality of rolling cone cutters, wherein one rolling cone cutter is rotatably coupled to the lower section of each leg and positioned along the leading surface of the corresponding leg, wherein each cone cutter has a cone axis of rotation that is radially spaced from the bit axis and is substantially perpendicular to a plane containing the bit axis, wherein each cone cutter includes a backface adjacent the leading surface of the corresponding leg, a nose opposite the backface, and a central passage extending axially therethrough from the backface to the nose, wherein each cone cutter is rotatably mounted to a journal extending from the leading surface of the lower section of the corresponding leg into the central passage of the corresponding cone cutter;

a plurality of circumferentially-spaced fixed blades, wherein one fixed blade extends radially outward from the radially outer surface of the lower section of each leg, wherein each fixed blade has a radially outer formation-facing surface;

wherein each cone cutter includes a first plurality of cutter elements arranged in a first circumferential row extending about the corresponding cone axis of rotation, wherein each of the first plurality of cutter elements includes a planar cutting face that is configured to engage and shear the subterranean formation when the bit body is rotated about the bit axis in the cutting direction;

wherein the trailing surface of the lower section of each leg includes a clearance recess configured to accommodate the first plurality of cutter elements of the circumferentially adjacent rolling cone cutter that trails the leg relative to the cutting direction during rotation of the rolling cone cutter about the corresponding cone axis and removal of the rolling cone cutter from the corresponding leg;

a second plurality of cutter elements mounted to the formation-facing surface of each fixed blade and configured to engage and shear the formation when the bit body is rotated about the bit axis in the cutting direction.

2. The drill bit of claim 1, wherein each journal is removably coupled to the corresponding lower section.

3. The drill bit of claim 2, wherein each journal is threadably coupled to the lower section of the corresponding leg.

4. The drill bit of claim 2, wherein the trailing surface of the lower section of each leg includes a clearance recess configured to prevent interference between the cone cutter coupled to the lower section of the circumferentially adjacent leg.

5. The drill bit of claim 2, wherein the trailing surface of the lower section of each leg includes a clearance recess configured to provide space for removal of the cone cutter and the journal coupled to the lower section of the circumferentially adjacent leg.

6. The drill bit of claim 5, wherein each angle $\varphi$ is less than 30°.

7. The drill bit of claim 2, wherein the cone axis of each cone cutter is oriented at an angle φ relative to the trailing surface of the circumferentially adjacent fixed blade that leads the cone cutter relative to the cutting direction, wherein each angle φ is an acute angle less than 45°.

8. The drill bit of claim 1, wherein each cone cutter includes a third plurality of cutter elements arranged in a second circumferential row that is axially spaced from the first circumferential row with respect to the cone axis of rotation, wherein each of the third plurality of cutter elements includes a planar cutting face that is configured to engage and shear the subterranean formation when the bit body is rotated about the bit axis in the cutting direction.

9. The drill bit of claim 8, wherein the cutting face of the radially outermost cutter element of the first plurality of cutter elements, relative to the bit axis, extends to a reference circle in end view, wherein the reference circle is defined by the full gauge diameter and is concentrically disposed about the bit axis; and wherein the cutting face of the radially outermost cutter element of the third plurality of cutter elements, relative to the bit axis, extends to the reference circle in end view.

10. The drill bit of claim 1, wherein each journal is secured within the central passage of the corresponding cone cutter with a plurality of locking balls positioned between the journal and the cone cutter.

11. The drill bit of claim 1, wherein each journal extends through a cylindrical bearing race disposed in the central passage of the corresponding cone cutter.

12. The drill bit of claim 1, further comprising a plurality of seal caps, wherein one seal cap is removably secured within the central passage of each cone cutter proximal the nose to seal off the central passage at the nose of the corresponding cone cutter.

13. A drill bit for drilling a borehole in a subterranean formation, the borehole having a gauge diameter, the drill bit comprising:

a bit body having a bit axis, a first end configured to be coupled to a lower end of a drill string, and a second end configured to engage the subterranean formation, wherein the bit body includes a plurality of legs circumferentially disposed about the bit axis, wherein each leg has a lower section extending axially from the second end of the bit body, wherein the lower section of each leg is circumferentially-spaced apart from each circumferentially adjacent lower section, and wherein each lower section has a leading surface relative to a cutting direction of bit rotation about the bit axis, a trailing surface relative to the cutting direction, and a radially outer surface extending circumferentially from the leading surface to the trailing surface of the corresponding lower section;

a plurality of rolling cone cutters, wherein one rolling cone cutter is rotatably mounted on a journal threadably coupled the lower section of each leg, wherein each cone cutter includes a backface adjacent the leading surface of the corresponding leg, a nose opposite the backface, and a central passage extending axially therethrough from the backface to the nose, wherein each journal extends from the leading surface of the lower section of the corresponding leg into the central passage of the corresponding cone cutter;

wherein the trailing surface of the lower section of each leg includes a clearance recess configured to accommodate the first plurality of cutter elements of the circumferentially adjacent rolling cone cutter that trails the leg relative to the cutting direction during rotation of the rolling cone cutter about the corresponding cone axis and removal of the rolling cone cutter from the corresponding leg;

a plurality of circumferentially-spaced fixed blades, wherein one fixed blade extends radially outward from the radially outer surface of the lower section of each leg, wherein each fixed blade has a radially outer formation-facing surface;

wherein each cone cutter includes a first plurality of cutter elements arranged in a first circumferential row extending about a corresponding cone axis of rotation, wherein each of the first plurality of cutter elements includes a planar cutting face that is configured to engage and shear the subterranean formation when the bit body is rotated about the bit axis in the cutting direction;

a second plurality of cutter elements mounted to the formation-facing surface of each fixed blade and configured to engage and shear the formation when the bit body is rotated about the bit axis in the cutting direction.

14. The drill bit of claim 13, wherein the cone axis of rotation of each cone cutter is radially spaced from the bit axis and is substantially perpendicular to a plane containing the bit axis.

15. The drill bit of claim 13, wherein the trailing surface of the lower section of each leg includes a clearance recess configured to provide space for removal of the cone cutter and the journal coupled to the lower section of the circumferentially adjacent leg.

16. The drill bit of claim 13, wherein each cone axis of each cone cutter is oriented at an angle φ relative to the trailing surface of the circumferentially adjacent fixed blade that leads the cone cutter relative to the cutting direction, wherein each angle φ is an acute angle less than 45°.

17. The drill bit of claim 16, wherein each angle φ is less than 30°.

18. The drill bit of claim 13, wherein each cone cutter includes a third plurality of cutter elements arranged in a second circumferential row that is axially spaced from the first circumferential row with respect to the cone axis of rotation, wherein each of the third plurality of cutter elements includes a planar cutting face that is configured to engage and shear the subterranean formation when the bit body is rotated about the bit axis in the cutting direction.

19. The drill bit of claim 18, wherein the cutting face of the radially outermost cutter element of the first plurality of cutter elements, relative to the bit axis, extends to a reference circle in end view, wherein the reference circle is defined by the full gauge diameter and is concentrically disposed about the bit axis; and wherein the cutting face of the radially outermost cutter element of the third plurality of cutter elements, relative to the bit axis, extends to the reference circle in end view.

20. The drill bit of claim 13, wherein each journal is secured within the central passage of the corresponding cone cutter with a plurality of locking balls positioned between the journal and the cone cutter.

21. The drill bit of claim 13, wherein each journal extends through a cylindrical bearing race disposed in the central passage of the corresponding cone cutter.

22. The drill bit of claim 13, further comprising a plurality of seal caps, wherein one seal cap is removably secured within the central passage of each cone cutter proximal the nose to seal off the central passage at the nose of the corresponding cone cutter.

* * * * *